US008747213B2

(12) United States Patent
Young

(10) Patent No.: US 8,747,213 B2
(45) **Date of Patent: *Jun. 10, 2014**

(54) PARTIAL CREDITS CASHOUT GAMING UNIT

(75) Inventor: J. Scott Young, Henderson, NV (US)

(73) Assignee: Bally Gaming, Inc., Las Vegas, NV (US)

( * ) Notice: Subject to any disclaimer, the term of this patent is extended or adjusted under 35 U.S.C. 154(b) by 230 days.

This patent is subject to a terminal disclaimer.

(21) Appl. No.: 13/467,808

(22) Filed: May 9, 2012

(65) Prior Publication Data

US 2013/0122994 A1 May 16, 2013

Related U.S. Application Data

(63) Continuation of application No. 12/205,537, filed on Sep. 5, 2008, now Pat. No. 8,182,334.

(51) Int. Cl.
*G07F 17/32* (2006.01)

(52) U.S. Cl.
USPC ..... 463/20; 463/16; 463/25; 463/29

(58) Field of Classification Search
USPC ..... 463/16, 20, 25, 29
See application file for complete search history.

(56) References Cited

U.S. PATENT DOCUMENTS 8,182,334 B2 * 5/2012 Young ..... 463/25
8,187,086 B2 * 5/2012 Young ..... 463/25

* cited by examiner

*Primary Examiner* — Omkar Deodhar
(74) *Attorney, Agent, or Firm* — Marvin Hein

(57) ABSTRACT

A system or method providing a player to cashout half of credits accumulated during gaming. Anonymous cashing out of credit is available to a player through routes both external and internal to a gaming machine.

17 Claims, 5 Drawing Sheets

PARTIAL CREDITS CASHOUT GAMING UNIT

CROSS-REFERENCE TO RELATED APPLICATIONS

This application is related to co-pending U.S. patent application Ser. No. 12/205,506, filed Sep. 5, 2008.

COPYRIGHT NOTICE

A portion of the disclosure of this patent document contains material that is subject to copyright protection. The copyright owner has no objection to the facsimile reproduction by anyone of the patent document or the patent disclosure, as it appears in the Patent and Trademark Office patent files or records, but otherwise reserves all copyright rights whatsoever.

FIELD OF THE INVENTION

This invention relates generally to a gaming system that facilitates continued play, and more particularly, to a system and methodology that permits credit cashout.

BACKGROUND

Traditionally, gaming machines have been designed for gaming purposes only. In this regard, gaming machines have been constructed only to include gaming functionality. Recently, however, casino owners have become aware that by adding additional features to gaming machines, they may be able to maintain a player's attention to the gaming machines for longer periods of time. This, in turn, leads to the player wagering at the gaming machine for longer periods of time, thereby increasing casino profits.

One technique that has been employed to maintain a player's attention at the gaming machine has been to provide players with access to gambling-related information. By attaching a small electronic display to the gaming device, gambling-related information, as well as news and advertisements can be sent to the player. The gambling-related information may include, for example, information on sports betting and betting options for those sporting events. Additionally, the gambling-related information may also include information such as horse racing and off-track betting. News and advertisements can also maintain a player's attention by providing the player with access to information ranging from show times, to restaurant and hotel specials, and to world events, thus reducing the need and/or desire for the player to leave the gaming machine.

It has been found that greater levels of flexibility in gambling activities and access are likely to make a player remain and gamble at the gaming machine for significantly longer periods of time. Thus, efforts have been made to make the system components, such as external keypads and display modules, to provide the functionality and capabilities that tend to maintain a player's attention.

Casino profits can also be optimized by devising other approaches to facilitate continued gambling at a machine. Conventionally, once a player decides to cashout winnings or credit, play must be ceased. In certain situations a player may wish to cashout a portion of winnings but continue play. In other situations, a player may wish to gamble with a partner by sharing money pooled by the individuals or may wish to gamble only a portion of a larger bill denomination, both without having to leave the gaming machine.

Accordingly, there is a need for a system that is capable of continued play while permitting partial credit or winnings to be cashed out. The present disclosure addresses these and other needs.

SUMMARY

Briefly, and in general terms, the present disclosure addresses the above and other issues by providing an user interface for use in a gaming machine configured with cashout functionality, wherein the gaming machine includes a gaming screen and a gaming processor. In one approach, cashout can be accomplished external to an electronic gaming machine and a request can be initiated with ticket print support to allow the electronic gaming machine to cashout to a printer. It is also contemplated that an external cashout request be first routed to a server-side application. In another approach, cashout can be provided internal to an electronic gaming machine. Further, anonymous cashout is contemplated.

In a specific embodiment, cashout can be initiated through a soft key defined by an electronic gaming machine. An electronic gaming machine can alternatively be provided with an additional touch screen button to achieve a cashout. Moreover, in one embodiment a half credit cashout is contemplated.

Additionally, one or more of the approaches described in the present disclosure permit couples gambling together to share one persons winnings while the other continues playing. The present disclosure can further facilitate couples with larger bills to split the money across multiple games and to cashout a portion of winnings to protect some of the money won while continuing to play a particular game.

One contemplated system includes a browser manager operating system for use with game devices, systems, and methods and which enables users to perform browser activities from a gaming machine. One embodiment of the browser manager operating system can include two main modules or components: a Browser Manager (BrowserMgr) and a Transaction Manager (TM). The Browser Manager communicates with the game provider on one hand to receive and package content, and communicates with the electronic gaming machine on the other hand to display this content and interact with the player through the browser window. The Transaction Manager functions as a mediator and negotiator between the application/game provider and the electronic gaming machine. The Transaction Manager may also act as a Banker in order to facilitate the placement, acceptance and disposition of wagers. Moreover, the Transaction Manager may confirm a wager and send a bar-coded confirmation to be printed on the electronic gaming machine's printer. In this way, cashout can be possible. The player may then place another wager or continue playing at the gaming machine. The Transaction Manager may additionally, authorize the cashier to payout the amount of a win. In another embodiment, the player may be able to take the ticket to a kiosk station linked to Transaction Manager to verify the win or loss, and cashout in the case of a win. In yet another embodiment, the player may be able to insert the ticket into the electronic gaming machine's bill validator to verify the win or loss. In this case, the electronic gaming machine may communicate with the Transaction Manager to verify the claim, and if a win, dispense a bar coded voucher that may be claimed like any other cash voucher. In still another variation of this embodiment, the amount of the win may be credited onto the electronic gaming machine on either the primary game or the secondary game.

Furthermore, a system configured to include one or more of such features can embody an embedded additional user interface which includes a web content capable display screen and an embedded processor. The web content capable display screen can present web information to a user via the display screen. The embedded processor preferably utilizes an internal operating system and communicates with the gaming processor. Preferably, the embedded processor reads incoming data, translates the data into a web protocol (web authoring language), if necessary, and maps the data to the web content capable display screen. In yet another embodiment, the gaming machine can lack an additional user interface but can include a cashout button permitting the player to cashout credit and continue play.

Other features and advantages of the present disclosure will become apparent from the following detailed description when taken in conjunction with the accompanying drawings, which illustrate by way of example, the features of the disclosure.

DETAILED DESCRIPTION

Figure 1:
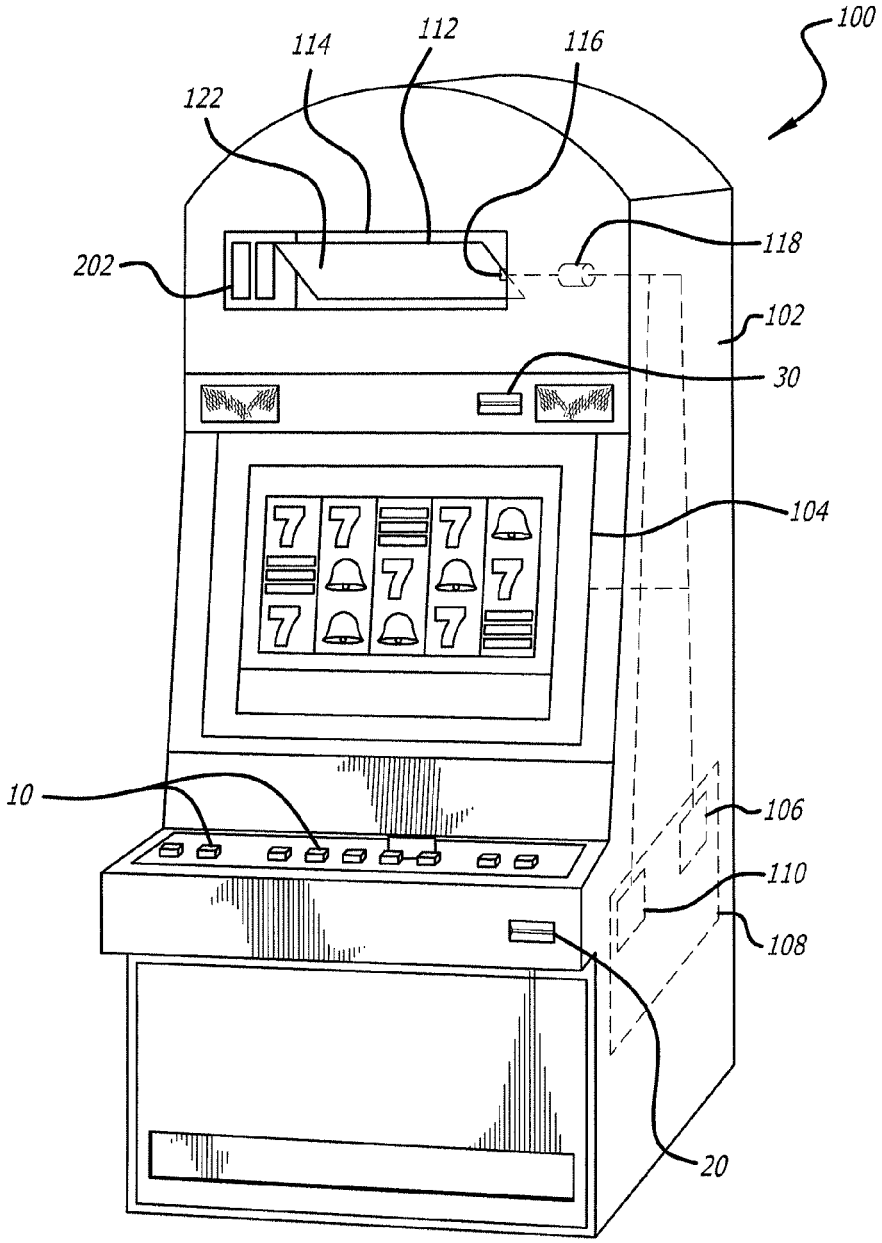
FIG. 1 is a perspective view, depicting one embodiment of a gaming machine.

Referring now to the drawings, wherein like reference numerals denote like or corresponding parts throughout the drawings and, more particularly to FIG. 1, there is shown one embodiment of a gaming machine which can be configured to provide cashout functionality. The cashout functionality can come in the form of a partial credits cashout. In one implementation, external to an electronic gaming machine, a device such as a gaming monitoring unit or a gaming transaction manager can be configured to use content to define a soft key to initiate a cashout request. Ticket print support can be provided to allow the electronic gaming machine to perform cashout to a printer. In another implementation, external to the electronic gaming machine, a cashout request can be first routed to a server-side application which issues a partial cashout request. In yet another implementation, internal to an electronic gaming machine, video based games can include a partial cashout touch screen button activation which prompts the electronic gaming machine to present a player with a list of possible cashout amounts. Thus, employing one or more of these approaches, couples gambling together can share winnings, break bills and cashout portions of winnings.

In one particular approach the gaming machine can include a primary display and an adjustable display. More specifically, as shown in FIG. 1, there is disclosed a gaming machine 100 having an upright gaming cabinet 102. The gaming cabinet 102 provides structural support and houses the components of the gaming machine 100. In addition, the gaming cabinet 102 is secured to prevent access to electronics and currency disposed within the gaming machine 100. As stated, external to the gaming machine a soft key can be defined by a gaming monitoring unit or game transaction manager to define a soft key to make a cashout request. Also, the electronic gaming machine can be configured with an additional partial cashout button. In either approach, limitations can be set upon the amount or increments of partial cashout. For example, increments of 250 credits can be cashed out or a number of possible cashout amounts can be determined by a threshold on a lowest amount presented.

As shown in FIG. 1, the first display 104 is fixed within the cabinet 102. In another embodiment, the first display 104 is pivotally mounted within the cabinet 102. Additionally, the second display 112 is positioned above the first display 104. In one embodiment, the second display 112 is smaller than the first display 104. As those skilled in the art will appreciate, the second display 112 may be positioned below the first display 104 or any location on the gaming machine 100 within the line-of-sight of a player.

Control of the first display 104 is managed by the electronics assembly 108. The electronics assembly 108 includes a computing device which processes inputs and generates outputs. Common computing devices in a gaming environment include PC based configurations. However, in additional embodiments (not shown), application specific integrated circuits provide efficient processing of a fixed set of tasks such as, but not limited to, receiving a wager or generating a game outcome. As shown in FIG. 1, the electronics assembly 108 is disposed within the cabinet 102 and includes a processor 106 and a controller 110. The processor 106 is enabled to execute software and/or firmware. The controller 110 includes circuitry for controlling a peripheral device, e.g., the first display 104, the second display 112, and/or other peripherals.

According to one embodiment, the displays 104, 112 are flat panel displays including by way of example only, and not by way of limitation, liquid crystal, plasma, electroluminescent, vacuum fluorescent, field emission, LCOS (liquid crystal on silicon), and SXRD (Silicon Xtal Reflective display), Laser, or any other type of panel display known or developed in the art. These flat panel displays may use panel technologies to provide digital quality images including by way of example only, and not by way of limitation, EDTV, HDTV, or DLP (Digital Light Processing). In another embodiment, the flat panel displays are widescreen displays that are mounted in the gaming cabinet in a portrait or landscape orientation. In other embodiments, the displays 104, 112 are cathode ray tube monitors or projection monitor displays. Further, the displays 104, 112 can include touch screen features and/or electronics for network communications.

As shown in FIG. 1, the first display 104 presents a five-reel video slots game. Alternatively, more or fewer reels may be used. In other embodiments, the five-reel video slot game can be replaced by any game, including mechanical slots, video keno, video poker, video blackjack, video roulette, Class II bingo, games of skill, or games of chance involving some player skill. For the sake of brevity and clarity, the following disclosure and examples of the game is a slot-type game, but those skilled in the art will appreciate that any of the above-referenced games or others may be presented in the gaming machine 100.

The second display 112 is disposed at least partially within a recessed section 114 of the cabinet 102. In one embodiment, the second display augments or supplements the features of the primary display. In one such embodiment, the second display 112 provides for bonus game features, secondary game features, player tracking features, account management interactivity, purchasing of goods, and advertising. According to one embodiment, the second display 112 is a graphical interface, which is the subject of U.S. patent application Ser. No. 10/943,771, filed Sep. 16, 2004, which is hereby incorporated herein by reference.

In one embodiment, the second display 112 includes a touchscreen 122 and is coupled with the electronics assembly 108. In particular, the touchscreen 122 is enabled to provide signals based on a player's alphanumeric input, whereby the signals are processed as inputs by the processor 106. A signal is an electromagnetic quantity by which information can be communicated. In another embodiment (not shown), the second display 112 is coupled with a central computer (not shown). In this regard, player tracking information can be managed either locally via the processor 106 or non-locally via a network (not shown).

As shown in FIG. 1, the second display 112 is mounted to the cabinet 102 such that the second display 112 is rotationally adjustable about a generally horizontal axis 220. In this regard, the second display 112 can be tilted to a variety of positions. In one embodiment, the second display 112 can be rotated in response to an input received via the touchscreen 122. For example, a player can enter a command instructing the display to tilt frontward or backward.

Additionally, a player identifier can be presented to the gaming machine 100 via a card reader 202. The card reader 202 is disposed adjacent to the second display 112 and is coupled to the second display 112. In this embodiment, the second display 112 and card reader 202 are upgrades to an existing gaming machine 100 which did not originally provide for network based bonus games.

Figure 2:
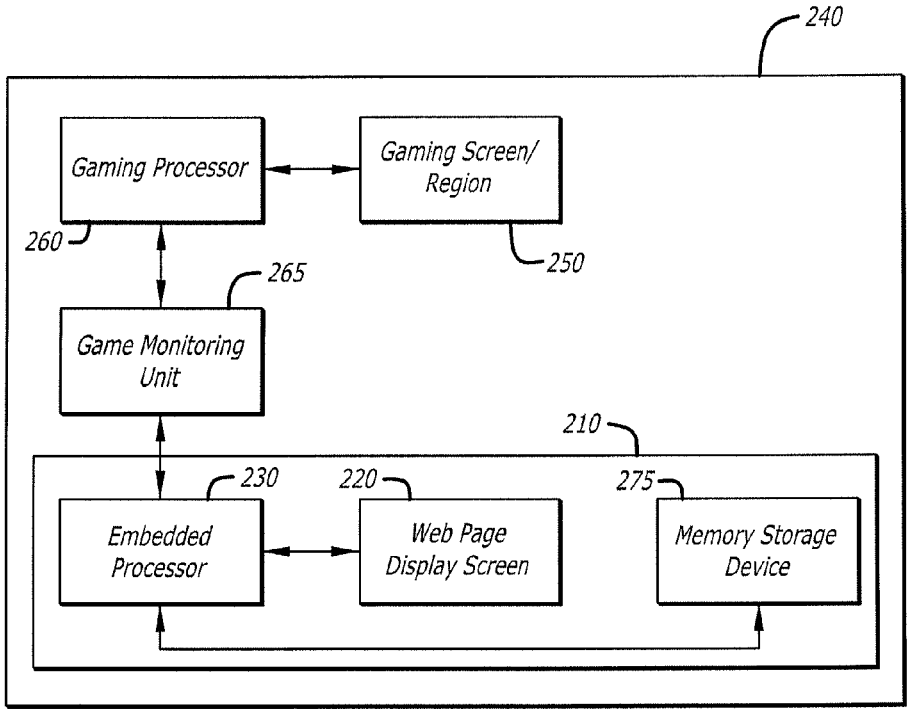
FIG. 2 illustrates a relational diagram of an embedded additional user interface utilizing a web page display screen and an embedded processor that receives data messages from a game monitoring unit that are translated into web page content and mapped to the web page display screen.

Turning now to FIG. 2, there is shown one embodiment of an embedded additional user interface 210 that can be incorporated into the gaming machine 100. Specifically, FIG. 2 shows an embedded additional user interface 210 that includes a web page display screen 220 and an embedded processor 230. The user interface 210 is incorporated into a gaming machine 240 that, in turn, includes a gaming screen 250, (and/or non-screen gaming region 250, e.g., spinning reels or other gaming presentation) gaming processor 260, and a game monitoring unit or a game transaction manager 265. The embedded processor 230 employs an internal operating system and communicates with the gaming processor 260. The embedded processor 230 reads incoming data, translates the data into a web authoring language, and maps the data to the web page display screen 220. The display screen 220 presents web page information to a user via the display screen, thereby increasing user excitement by providing a richer gaming experience. The game monitoring unit 265 monitors the information that is input through the user interface 210. The user interface 210 communicates with the game monitoring unit or game transaction manager 265. Thus, the game monitoring unit or game transaction manager can use content to define a soft key to initiate a partial cashout request.

Figure 3:
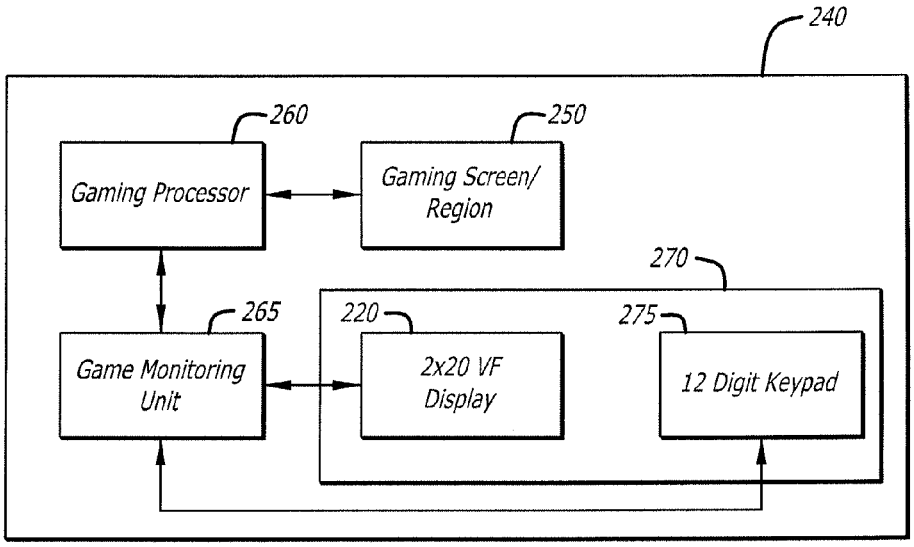
FIG. 3 illustrates a relational diagram of another approach to a gaming system.

As shown in FIG. 3, an alternate approach to a gaming machine can include a single video display screen as a gaming screen 250 for the gaming machine 240, while additional system components 270 were attached or juxtapositioned next to the gaming machine. In this approach, the gaming screen 250 of the electronic gaming machine can include an additional touch screen button which effectuates the partial cashout request. The same can be accomplished anonymously.

Referring again to FIG. 2, in situations involving multiple gaming machine (or gaming component) manufactures, an embedded additional user interface 210 can be incorporated into a gaming machine (either originally or by retrofitting) without requiring access to the game logic or other gaming systems that might be proprietary and inaccessible with a gaming machine from another gaming manufacturer. Thus, in a preferred embodiment of the claimed invention, the embedded additional user interface 210, which includes a web page display screen 220 for presenting supplementary information to a player, is incorporated into a gaming machine 240 in addition to the standard gaming screen 250 typically found in a gaming machine. The embedded additional user interface 210 may also be incorporated into a gaming machine 240 that utilizes a gaming region (e.g., a reel-spinner) instead of a standard gaming screen 250. This supplemental information may include general gaming information, player specific information, player excitement and interest captivation content, advertising content (targeted or otherwise), and the like. Further, in other preferred embodiments, the embedded additional user interface 210 may have the ability to interact with the game logic of the gaming processor 260, and thus, provide further functionality, such as bonus games and/or the ability to incorporate awards, promotional offers, or gifts from the web page display screen 220 to the gaming screen 250. Moreover, the web page display screen 220 may display supplemental information in an "attract mode" when there is no game play occurring.

In an embodiment of the disclosure, the embedded additional user interface 210 is used to make casino services more accessible and friendly to casino patrons such as by providing a cashout feature. In one embodiment, the embedded additional user interface 210 is designed to interface with the hardware configuration of game platforms currently employed in an existing gaming communication systems network, thus decreasing implementation costs for the casino. A standard gaming network interface to the systems network, such as a Mastercom system, includes a multi-drop bus method of communicating to a keypad and display. The Mastercom system is available from Bally Manufacturing, and is described in U.S. Pat. No. 5,429,361 to Raven et al. incorporated herein by reference. One such currently utilized bus is an EPI bus (Enhanced Player Interface bus), which uses industry standard I.sup.2C hardware and signaling. Moreover, further details of a user interface system for a gaming machine can be found in co-pending U.S. application Ser. No. 110/943,771, the contents of which are incorporated by reference.

Figure 4:
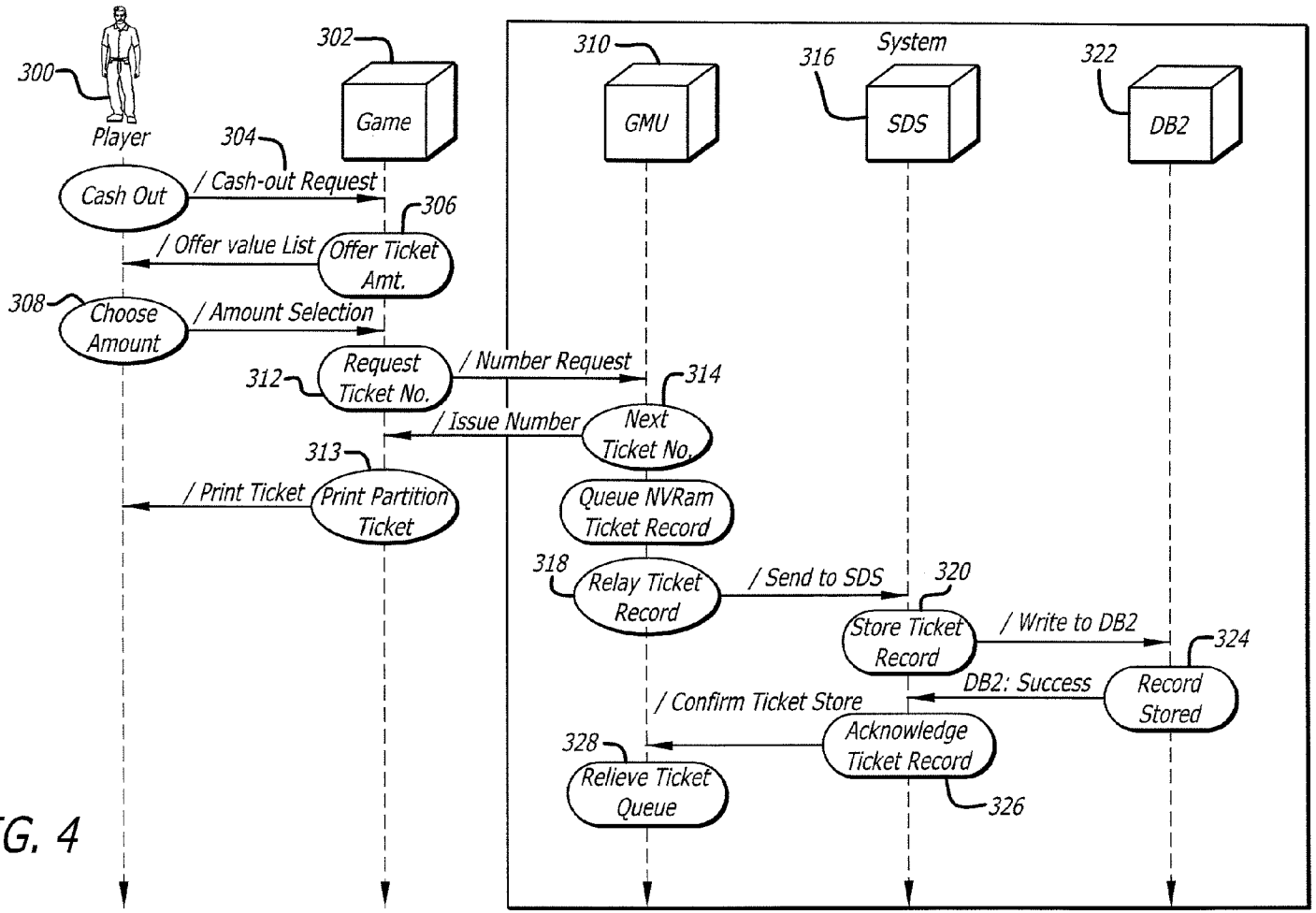
FIG. 4 is a flow chart, depicting a first possible implementation of the present disclosure.
Figure 5:
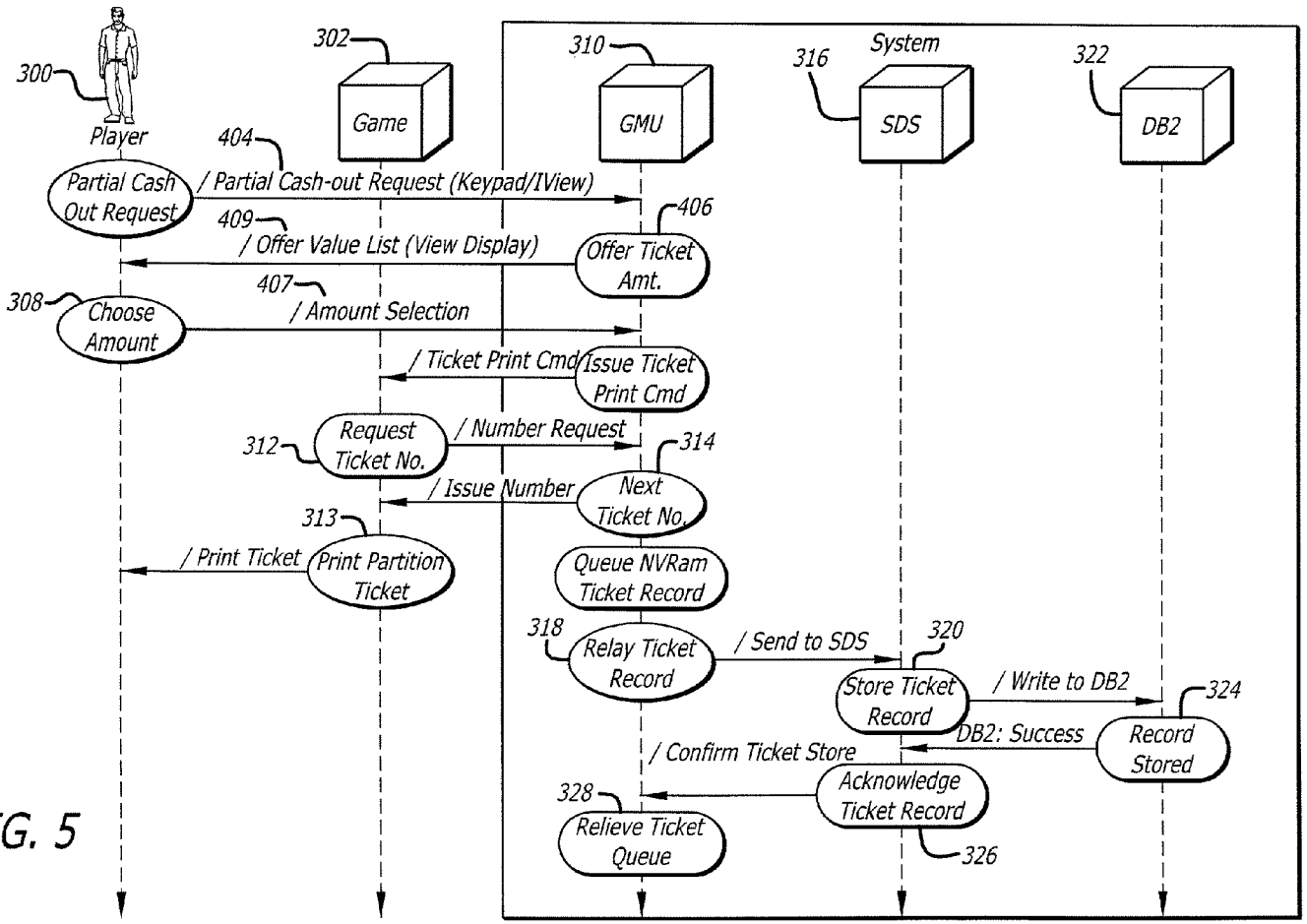
FIG. 5 is a flow chart, depicting a second possible implementation of the present disclosure.

Turning now to FIGS. 4 and 5, two possible implementations of a partial cashout system are presented. With specific reference to FIG. 4, a player 300 playing a game 302 can make a cashout request 304 through the game 302. The game 302 having ticket printing enabled can make upon determining amounts available for cashout, a ticket offer amount 306. The player 300 chooses from the amounts offered 308 and communicates this through the game 302 to the gaming monitoring unit (or game transaction monitor) 310. A ticket number request 312 is made and ticket numbers (for e.g. Barcodes) and tickets are generated and presented 313 prior to notification of the slot data system (SDS) 316. The ticket record is relayed 318 to the SDS which stores the ticket record 320 and writes to the DB2 322 which the record is stored 324. The DB2 322 communicates this and the SDS acknowledges the ticket record 326 as well as confirms the same to the gaming monitoring unit 310 which thereafter relieves the ticket queue 328.

In a related implementation (See FIG. 5), a partial cashout request 404 can bypass the game itself 302 and be sent directly to a gaming monitoring unit 310. The gaming monitoring unit 310 then communicates directly to the player 300 a ticket amount offer 406. The player in turn chooses an amount 308 to cashout and communicates thus 408 directly to the gaming monitoring unit. Tickets are then numbered and printed as previously described as are the information regarding the transactions stored and relayed.

Figure 6:
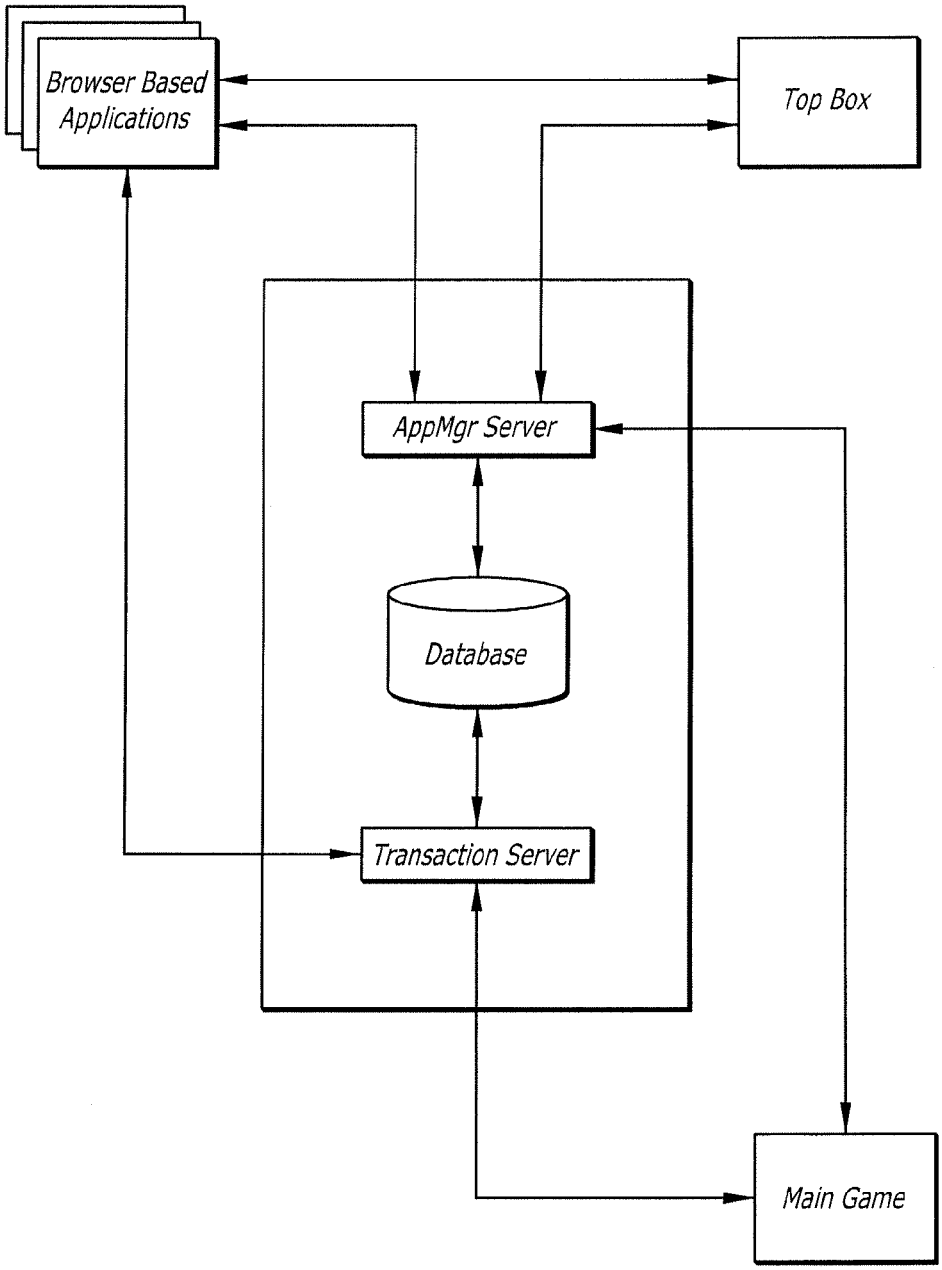
FIG. 6 is a block diagram of the various communications between a main game CPU and another application.

With reference now to FIG. 6, one example of a browser manager server that can be utilized to initialize and configure one or more browser windows on a gaming device display screen is presented. The browser manager has the ability to configure specific URLs for each browser window, configure and Z-order depth for each window, set window size and position, and call functions on the browser pages. A browser client side application on a gaming device is capable of creating multiple windows on an electronic gaming device and responding to said server configuration or browser message commands.

It should be noted that a variety of game architectures can be used to provide game play functions as well as access to other electronic gaming machines and servers through networks, as described below. The particular architecture shown is a generic architecture using components typical to game apparatuses suitable for use with the disclosed embodiments. An electronic gaming machine may take a variety of forms, including a video game apparatus having one or more display screens; a mechanical game having playing pieces and/or other moving mechanical parts; a personal computer system; a "network computer;" a television including or connected to a microprocessor (e.g. a "set top box") for the Internet or other information access, or another apparatus.

As described below, the electronic gaming machine is used by a player in a "gaming environment." This term is intended to refer to any location, public or private, in which games can be used. For example, public gaming environments include such places as arcades, stores, restaurants, bars, casinos, bowling alleys, stations, hotels, airports, airplanes, cruise ships, gymnasiums, health clubs, or other public places that can offer the electronic gaming machines for use by players and which can provide prizes to players of the game apparatus. A "gaming environment" need not ordinarily provide games to the public. In other embodiments, a "gaming environment" may be a private place, such as a player's home or personal residence, office or other place of employment, private club, and the like.

An electronic gaming machine may include a game processor. The game processor implements (e.g., controls, influences, coordinates, monitors, calculates, and the like) the functions of the electronic gaming machine during a game process and includes several input and output functions. The game processor controls the game apparatus by receiving inputs from a player, from other game apparatuses, from a server (described below), from a progressive bonus apparatus, and from other sources. The game processor also controls output signals to update the game process when appropriate. In addition, the game processor controls the browser manager operating system of the disclosed embodiments by calculating when prizes are awarded, calculating and updating prize lists and prize costs, and other functions, as described below. Game processor preferably includes a digital microprocessor or a similar controller device, and other electronic components. The operation of game processor is described in greater detail below. The game processor is preferably provided within a housing of electronic gaming machine.

Monetary input device is used to receive the monetary input that is inserted by a player into the game apparatus in the gaming environment. For example, coins can be received in return for the player's use of the game apparatus. A coin deposit slot can accept standard currency coins, bills, or game tokens that may be available in the gaming environment, and also typically includes a coin return button and coin return slot. Once one or more coins are accepted, the coins are routed to a cash box and a signal is sent to game processor to increase the player's game credits, i.e., to indicate that one or more game plays have been paid. Coin slots and boxes suitable for use in electronic gaming machine are readily available on the commercial market.

Alternatively, other monetary input devices can be used, such as debit card or credit card readers well known to those skilled in the art, or "smart card" readers which can read and write electronic information to and from the card. For example, "E-cash," "cybercash" or other electronic monetary forms can be used. In other embodiments, user verification or validation can be input by the player, such as a player identification and/or password that, for example, allows a monetary value to be billed to a player or deducted from a player's monetary account at a bank or other institution. Herein, the term, "monetary input," is intended to also refer to other types of player validation for use of a game in addition to those forms mentioned above. In alternate embodiments located in non-public gaming environments (e.g., at a user's home), or for other applications, such as promotional uses of electronic gaming machine, monetary input may not be necessary for the player to use electronic gaming machine.

Input devices are used by a player or user to provide input to the electronic gaming machine to influence game events during a game process and to achieve one or more predetermined goals or tasks for scoring points and winning prizes or other types of awards. The input devices can also be used to select prizes within the browser manager operating system and method of the disclosed embodiments. Alternatively, separate input controls can be used for the prize functions of the electronic gaming machine.

Player input typically includes game commands provided by controlling devices such as buttons, a keyboard, dials, joystick controls, a touch screen, a track ball, a mouse, a gun device, a steering wheel, foot pedals, speech input through a microphone, or any other input used in playing a game and providing selections. For example, the player can press a button to tilt a playing surface to guide a playing piece, move a joystick to control a graphical object displayed on a video screen, or toss a playing piece into a target aperture having sensors to detect the present playing piece. Each type of user input can provide a particular game command to the game processor, and the game processor interprets the commands and influences game states and game events in the game process accordingly.

Various other types of devices can also be included in electronic gaming machine as input devices to allow the processor to monitor the game. For example, sensors of various types can be employed to detect the paths of playing pieces directed by the player, detect when playing pieces have been dispensed, detect when a game is over, detect cheating actions by the player, and the like. Also, input devices such as buttons, switches, and the like allow the player of the game to make various selections concerning game play. For example, a player could select a one or two player game, a preferred award type, a progressive option, and the like, using additional controls on a front panel of the electronic gaming machine. Moreover, various cashout options can be made available to the player.

Game output devices may influence the game and/or provide feedback to the player about the current state of the game process. For example, motors or solenoids can influence mechanical components of the game in response to player commands, such as tilting a playing surface, dispensing a playing piece, spinning a wheel, and the like. Feedback is perceived by the player preferably in the form of visual, auditory, and/or tactile feedback. A video display screen can provide visual feedback such as images to the player during the game process. Other visual output devices can include one or more score displays, lamps or other light sources positioned on or surrounding a "game space" (e.g., a play field or area of game action).

Game output devices such as speakers, buzzers, alarms, and other devices provide auditory feedback, such as sound effects during a game process, synthesized or recorded speech, and the like. Game output devices, such as motors, solenoids, or other actuators can provide forces on the game apparatus or on controls handled by the player to provide tactile feedback in the form of vibration, jolts, and the like. One or more of the game output devices can also be used to display information related to specific prizes that can be won by the player when using the electronic gaming machine, as described below. Game output devices can also include a coin return slot for returning coins or tokens or providing other cash prizes after a game is played. Game processor preferably commands such feedback to the player by sending out control signals to the various output devices in electronic gaming machine when appropriate.

The Browser Manager is an application that sits on a host server, communicates with app/game/3rd party servers and with the Player Terminals on the floor. In one embodiment of a browser manager operating system, a browser application is initiated in response to some event (e.g., player inserts card/player inserts money/some event at host). Through some logic, (e.g., a rule-based system that determines the screen space negotiation) the Browser Manager decides or is instructed to create a layout and present applications in the panel.

In one particular embodiment of a browser manager operating system and method, when the player starts a game (e.g. by pressing a button on the Keno page), the page requests a game from the Game Server. The Game Server requests approval from the Transaction Manager. The Transaction Manager in turn queries the Player Terminal (OS-gamemgr) for credits. If the Player Terminal has the credits, it deducts the credit meter and sends a response (ACK/yes) to the Transaction Manager. The Transaction Manager records the transaction in its database and sends the approval message to the Game Server.

The Game Server starts a game and sends a StartGame message with the GameID (e.g., 1234) to the Browser Manager. The Browser Manager records the GameID in the tblSessionApps table. This allows the Browser Manager to resume the game, if the player cashes out before seeing the game complete, and returns at a later time. When the game is completed, the game server sends an EndGame message with the GameID. The Browser Manager erases the GameID field of that session.

In one example, the game server initiates a game with the Browser Manager as follows: (1) Bet. Player hits a bet 5 button placing a wager/play a game. The message is sent to the originating game server. (2) Debit 5. The Game server asks the Transaction Manager if the credits are available and claimed for game play. (3) Transaction Manager sends a message to the Player Terminal asking for 5 credits. (4) Gamemgr tries to deduct credits by 5 and sends status to Transaction Manager. (5) Transaction Manager records the transaction in its database and sends Y,N to Game server. (6) Game server either commences game or disallows it. (7) If game is started, GameServer sends GameID to Browser Manager which records it in the table.

To end a player's sessions, in response to some event (e.g., player cashing out, player taking card out, host determined event), the Browser Manager may send a new layout to the Player Terminal, such as a Browser Manager with just one window displaying a banner (e.g., a marketing screen on the top screen in Idle mode, with for example, "Coming Soon" titles).

Referring now to a session termination event (e.g., cashout), the player may be asked if he would like to save his session. If player chooses "Yes," the session tables are updated with the end time. If the player has not been identified by PlayerID, the session identifier can be printed on a ticket. The ticket may be deemed good for a predetermined (230/260/etc) number of days. If player chooses "No," the session entries may be deleted from the session tables. Alternatively, the player may choose to select among the various available partial cashout options.

With respect to session resumption, when the player returns at a later time and inserts the ticket at any Player Terminal, the SessionID is read from the ticket, and sent to the Browser Manager. The Browser Manager looks at the session tables, pulls the information for the session, and prepares a message to the Player Terminal with the Browser layout and URL information. If the player had been waiting for a game result when he cashed out partially or completely; there should be a GameID for that game session in the tblSessionApps table. The Browser Manager may include that GameID in the URL message. The Browser windows then load the URLs with GameIDs, pointing to the game servers. The game servers pull up the results for that game and present it in the Browser windows.

In still another embodiment of the browser manager operating system and method, when the player session ends (e.g., credits go to zero for a period of time, or the player card is pulled) then the browser content returns back to its original browser manager controlled frames and sizes. This typically provides the base game focus of the main portion of the top monitor. In yet another embodiment, the Browser Manager or Z-order director server may "auto-flip" through various content and URLs on the top monitor including the natively-rendered, base game content.

Although the invention has been described in language specific to computer structural features, methodological acts, and by computer readable media, it is to be understood that the invention defined in the appended claims is not necessarily limited to the specific structures, acts, or media described. Therefore, the specific structural features, acts and mediums are disclosed as exemplary embodiments implementing the claimed invention.

Furthermore, the various embodiments described above are provided by way of illustration only and should not be construed to limit the invention. Those skilled in the art will readily recognize various modifications and changes that may be made to the claimed invention without following the example embodiments and applications illustrated and described herein, and without departing from the true spirit and scope of the claimed invention, which is set forth in the following claims.

The invention claimed is:

1. In a gaming system including a slot data system and a gaming monitoring unit or gaming transaction manager coupled to the slot data system, an electronic gaming unit providing partial cashout, comprising:

a gaming processor, comprising circuitry for:

receiving a partial cashout request from a player of the electronic gaming unit; and requesting data representing a partial cashout corresponding to the partial cashout request from the gaming monitoring unit or gaming transaction manager; and a ticket printer for printing a ticket reflecting the partial cashout representative data before notification of the slot data system.

2. The gaming unit of claim 1, wherein the gaming processor further comprises circuitry for:

presenting one or more partial cashout offer amounts; and receiving a player choice from among the partial cashout offer amounts.

3. The gaming unit of claim 1, wherein the gaming processor circuitry requests partial cashout representative data including possible cashout amounts.

4. The gaming unit of claim 1, wherein the gaming processor determines possible cashout amounts.

5. The gaming unit of claim 1, wherein the gaming processor requests partial cashout representative data including data representing bar codes for tickets.

6. The gaming unit of claim 1, wherein the electronic gaming unit circuitry sends data confirming printing of tickets to the gaming monitoring unit or gaming transaction manager.

7. The gaming unit of claim 1, wherein the electronic gaming unit circuitry presents a partial credit cashout touch screen button to the player.

8. The gaming unit of claim 1, wherein the electronic gaming unit circuitry provides for anonymous cashout.

9. In a gaming system including a slot data system and a gaming monitoring unit or gaming transaction manager coupled to the slot data system, an electronic gaming unit providing partial cashout, comprising:

a gaming processor comprising circuitry for communicating with the gaming monitoring unit or gaming transaction manager; and a printer for printing a ticket reflecting a partial cashout;

wherein:

a partial cashout request is sent from a player of the electronic gaming unit to the gaming monitoring unit or gaming transaction manager;

data representing a partial cashout corresponding to the partial cashout request is sent from the gaming monitoring unit or gaming transaction manager to the gaming processor; and the ticket printer prints a ticket reflecting the partial cashout representative data before notification of the slot data system.

10. The gaming unit of claim 9, wherein the gaming monitoring unit or gaming transaction manager presents one or more partial cashout offer amounts to the player and receives a player choice from among the partial cashout offer amounts.

11. The gaming unit of claim 9, wherein the partial cashout representative data from the gaming monitoring unit or gaming transaction manager includes possible cashout amounts.

12. The gaming unit of claim 9, wherein the partial cashout representative data from the gaming monitoring unit or gaming transaction manager includes data representing bar codes for tickets.

13. The gaming unit of claim 9, wherein the electronic gaming unit circuitry sends data confirming printing of tickets to the gaming monitoring unit or gaming transaction manager.

14. The system of claim 9, wherein the gaming monitoring unit or gaming transaction manager defines a soft key configured to allow a player to initiate a partial cashout request.

15. The gaming unit of claim 9, wherein the electronic gaming unit circuitry presents a partial credit cashout touch screen button to the player.

16. The system of claim 9, wherein the gaming monitoring unit or gaming transaction manager communicates directly with a player.

17. The gaming unit of claim 9, wherein the electronic gaming unit circuitry provides for anonymous cashout.

* * * * *